US005127766A

United States Patent [19]

Matsuoka et al.

[11] Patent Number: 5,127,766

[45] Date of Patent: Jul. 7, 1992

[54] APPARATUS AND METHOD FOR CONTROLLING THE INNER PRESSURE OF AN AIR BAG IN AN AIR INFLATION/DEFLATION WEIR MADE OF FLEXIBLE FILM

[75] Inventors: Haruhiko Matsuoka; Yoshiomi Tsuji; Ichiro Maruyama, all of Osaka, Japan

[73] Assignee: Sumotomo Electric Industries, Ltd., Osaka, Japan

[21] Appl. No.: 605,455

[22] Filed: Oct. 30, 1990

[51] Int. Cl.[5] ..... E02B 7/20

[52] U.S. Cl. ..... 405/115; 405/91

[58] Field of Search ..... 405/115, 114, 91; 52/2, 52/2.11, 2.17, 2.22

[56] References Cited

U.S. PATENT DOCUMENTS 4,728,221 3/1988 Tsuji et al. ..... 405/115

FOREIGN PATENT DOCUMENTS 4011702 6/1940 Japan .
442371 1/1944 Japan .
0133916 8/1982 Japan ..... 405/115
0033620 2/1983 Japan ..... 405/115
0041506 3/1984 Japan ..... 405/115
0199110 10/1985 Japan ..... 405/115
0286410 12/1986 Japan ..... 405/115
1600939 10/1981 United Kingdom ..... 405/115

OTHER PUBLICATIONS

"Technical Standards for the Collapsible Dam Made of Rubber Coated Cloth", edited by Ministry of Construction, published by the Foundation of National and Development Technology, Aug., 1983, pp. 67-71 and 53.

*Primary Examiner*—Dennis L. Taylor
*Attorney, Agent, or Firm*—Cushman, Darby & Cushman

[57] ABSTRACT

An air inflation/deflection weir having an air bag made of a flexible film attached to the bed and the vertical bank of a river. The weir is adapted to be inflated and deflated by charging and discharging air into and out of the air bag, wherein the effect of the change of the atmospheric air temperature on the inner pressure of the air bag is eliminated and the inner pressure of the air bag is always maintained at predetermined valve. This inflates and raises the weir to a predetermined height in accordance with the detected water levels upstream and downstream of the weir. Maintaining the pressure inside the air bag, avoids abnormally high or low inner pressure of the air bag that would otherwise cause the air bag to burst or buckle resulting in a flood.

6 Claims, 3 Drawing Sheets

APPARATUS AND METHOD FOR CONTROLLING THE INNER PRESSURE OF AN AIR BAG IN AN AIR INFLATION/DEFLATION WEIR MADE OF FLEXIBLE FILM

BACKGROUND OF THE INVENTION

The present invention relates to an apparatus and method for controlling the inner pressure of an air bag in an air inflation/deflation weir made of a flexible film.

Description of the Prior Art

An air inflation/deflation weir made of a flexible film comprises an air bag made of a flexible film such as a rubberized cloth constituting a weir body which is attached to the bed and the vertical bank side of a river in the direction across the stream at the river. Introducing air introduced to the bag inflates and sets-up the air bag. On the other hand, discharging air from the bag deflates sets-down the bag. (refer, for example, to Japanese Patent Examined Publications Sho. 40-11702 and 44-2371), However, in the convention air inflation/deflation weir, the inner pressure of the air bag fluctuates remarkably depending on the atmospheric temperature. For instance as the atmospheric temperature increases, an abnormally high pressure may occur inside the air bag, which could possibly exceed the designed strength of the air bag. On the other hand, if the temperature of the atmospheric air decreases, the inner pressure of the air bag decreases resulting in buckling of the air bag and causing V-shaped notches in the upper portion, through which water stored behind the weir may be discharged. Further, if the atmospheric temperature is low, the weir may fail to be deflated even when water of a river rises to predetermined dangerous level, which would bring about a flooding disaster.

FIG. 4 shows a conventional device for operating the air inflation/deflation weir of this type. The device comprises, a blower 31 for charging air to the inside of an air bag 40, an air charge valve 33 disposed in a middle portion of an air charge pipe 32 connecting the blower 31 to the air bag 40, an air discharge valve 34 disposed in a middle portion of an air discharge pipe 37 for discharging air from the air bag, a bucket type automatic weir deflating device 35, an excess pressure preventive device 36 constituted as a water sealing pipe. When the weir is inflated to setup, the air charge valve 33 is opened and the blower 31 is driven to charge air into the air bag 40.

Upon flooding of a river, the air discharge valve 34 is opened by the automatic weir deflating device 35, thereby causing the air bag 40 to deflate and set-down. In addition, the air discharge valve 34 may be manually opened to deflate and set-down the bag 40 in accordance with the situation.

The excess pressure preventive device 36 is provided for preventing the inner pressure of the air bag from increasing beyond a predetermined level. This device 36 prevents the air bag from bursting if it is forgotten interrupt the operation of the blower 31 after the air bag is fully inflated, or if the air discharge valve 34 should to fail to open when the water level of the river is elevated. The excess pressure preventive device discharges an excess pressure in the air bag from the end of the insertion pipe in the water sealing tube.

In FIG. 4, there are also shown an air charge and discharge pipe 38 as a common portion of the air charge pipe 32 and the air discharge pipe 37, an upstream level detection pipe line 39, an automatic weir deflating level

41, a pressure gage (pressure switch) 42 for detecting the pressure in the air bag, a water level 43 at which the bag in inflated and set-up, a water storage bucket 44, a draining valve 45 for the water storage bucket 44, a lever type butterfly valve 46, a manual valve 47, a weir top end 48, a weir disposing reference plane 49, strainer 50 and a pipeline 52 for detecting the inner pressure of the air bag 40.

In the conventional air inflation/deflation weir as constructed above, inner pressure of the air bag 40 and the tension exerting on the air bag 40 change in accordance with the water depth upstream and downstream of the weir as shown in FIGS. 2 and 3.

FIG. 2 shows the change of the inner pressure of the air bag 40 in accordance with the change of the water depth at the upstream of a weir having 1 m height, for each of the cases where the water depth at the downstream is 0 m, 0.5 m and 1.0 m. For instance, the inner pressure of the air bag changes from 0.045 kg/cm$^2$ to 0.156 kg/cm$^2$ as the upstream water depth changes from 0 to 1.5 m in a case where the water depth at the downstream is 0 m. In this instance, the tension exerting on the air bag changes from 2.5 kg/cm to 7.2 kg/cm as shown FIG. 3.

Accordingly, when designing strength of the material used for the air bag in the weir, the maximum value for the tension on the air bag is 7.5 kg/cm for the upstream water depth at the maximum. Further, the height of the water in the water sealing insertion pipe in the excess pressure preventive device 36 is set corresponding to the maximum inner pressure: 0.156 kg/cm$^2$ of the air bag when the water depth at the upstream is maximum.

In addition to changes in upstream and downstream water depth, changes in atmospheric air temperature are considerable the inner pressure of the air bag. This will be explained below by means of equations. The following equation is established:

$$\frac{P_1 \cdot V_1}{T_1} = \frac{P_2 \cdot V_2}{T_2}$$

where $T_1$: initial temperature of air in the air bag (absolute temperature)

$T_2$: temperature of air in the air bag after change (absolute temperature)

$P_1$: initial inner pressure of the air bag at $T_1$ (absolute pressure)

$P_2$: inner pressure in the air bag after change at $T_2$ (absolute pressure)

$V_1$, $V_2$: inner volumes of the air bag at $T_1$ and $T_2$ respectively:

Now assuming that the air temperature in the air bag is elevated from its initial value of 15° C. to 35° C. in accordance with the change of the atmospheric temperature under the state: $V_1 = V_2$, the inner pressure of the air bag of 0.1 kg/cm$^2$, the upstream water depth of 1.0 m, then the inner pressure of the air bag ($P_0$), also in view of FIG. 2, is expressed as:

$$\frac{1.0033 + 0.1}{173 + 15} = \frac{1.0033 + P_0}{273 + 35}$$

$P_0 = 0.179$ (kg/cm$^2$)

In a weir under the condition of water depth at the upstream of 1 m, weir height of 1 m and inner pressure of the air bag of 0.1 kg/cm$^2$, if the air temperature in the air bag is elevated depending on the change of the atmospheric air temperature from 15° C. to 35° C., the inner pressure of the air bag is increased to 0.179 kg/cm$^2$. The tension exerted on the air bag in this case is calculated to be 8 kg/cm (refer to the notes described below), which exceeds the maximum tension 7.2 kg/cm of the air bag when the upstream water depth is at the maximum, resulting in a problem in view of the strength. (note)

$$T = \frac{1}{2}\alpha \cdot \rho \cdot g \cdot H^2$$

where

T: tension, $\alpha$: inner pressure coefficient, $\rho$: water density, H: weir height (Technical Standards for Collapsible Weir Made Rubber Coated Cloth (secondary draft), page 71, edited by The Ministry of Construction, River Department, Water controlling Section, August 1983, published from Foundation of National and Development Technology).

In this calculation, the tension on the air bag reaches 8 kg/cm$^2$ when the water depth at the upstream is 1 m and the tension on the air bag is further increased as the water depth at the upstream increases to its maximum value (1.5 m in this case), which further indicates the lacking strength of the weir.

On the other hand, in a weir under the conditions of the upstream water depth of 1 m, weir height of 1 m and inner pressure of the air bag of 0.1 kg/cm$^2$, when the air temperature in the air bag is lowered from the 35° C. to 15° C. due to the change of the atmospheric air temperature, the inner pressure of the air bag is reduced to 0.03 kg/cm$^2$ according to the calculation in the same way as described above.

If the inner pressure of the air bag is reduced to such a level, V-shaped notches are formed in the weir of this type, in which the top of the weir is not extended uniformly in the axial direction of the weir but buckled to form V-shaped notches (refer to FIG. 5, in which 40 represents the air bag and 60 represents the V-shaped notch) and most of water stored in the weir is released therefrom. It is generally considered for the air inflation/deflation weir that the V-notch phenomenon occurs under non-over-flowing state if the inner pressure of the air bag is reduced to less than 50% of the pressure for the standard weir height, that is, less than 0.05 kg/cm$^2$ in this case (refer for instance to "Technical Standards for the Collapsable Dam made of Rubber-Coated Cloth (secondary draft), edited by the Ministry of Construction, River Department, Water Control Section, published from National Development Technology Research Center, August, 1983).

Further, the weir shown in FIG. 4 has a system such that air in the air bag is discharged from the insertion pipe of the water sealing pipe by the use of the excess pressure preventive device 36 when the air discharge valve 34 is not opened by failure in the event that the water depth at the upstream reaches the automatic deflating water depth 41. However, if the inner pressure of the air bag is reduced abnormally under the effect of the atmospheric air temperature, it is likely to bring about a situation where the inner pressure of the air bag does not reach the designed maximum value (the pressure at which air in the air bag starts to be discharged from the insertion pipe in the water sealing pipe) even when the upstream water depth reaches the automatic deflating water depth and, accordingly, the weir does not collapse automatically even if the water level of the river is increased greatly, which could lead to a serious disaster such as flooding of the river.

That is, if the air temperature in the air bag changes only by 20° C. due to a change of the atmospheric air temperature, an abnormal situation may occur such that abnormal tension is exerted on the air bag, V-shaped notches are formed thereby causing the stored water to flow out, or the weir may not automatically collapse resulting in flooding of the river.

SUMMARY OF THE INVENTION

It is, accordingly, an object of the present invention to overcome the foregoing problems and to provide an apparatus and method of controlling the inner pressure of an air bag provided in an air inflation/deflation weir made of a flexible film so that the weir can always function effectively irrespective of the change of the surrounding atmospheric temperature.

The object of the present invention can be attained by disclosing an apparatus and a method of controlling the inner pressure of an air bag in an air inflation/deflation weir comprising an air bag made of a flexible film constituting a weir body attached to the bed and the vertical bank sides of a river, in which air as a pressure medium is charged inside the air bag to inflate and rise the air bag or air is discharged from the inside of the air bag to deflate and collapse the air bag. The method comprises eliminating the change of the inner pressure of the air bag, which is caused by the change of the atmospheric temperature, and maintaining the inner pressure of the air bag at a predetermined value so that the weir is inflated and rises to a predetermined weir height relative to water levels upstream and downstream of the weir based on such water levels detected.

Further, the air inflation/deflation weir made of a flexible film in accordance with the present invention used for practicing the above-mentioned method has a pressure control means for eliminating the change of the inner pressure of an air bag, which is caused by the change of the atmospheric temperature, and a means for maintaining the inner pressure of the air bag at a predetermined value so that the weir is inflated and rises to a predetermined weir height relative to water levels upstream and downstream of the weir based on such water levels detected, wherein the pressure control means comprises a pressure detector for detecting the inner pressure of the air bag, water level detectors. for detecting the water levels at the upstream and the downstream of the weir respectively, a blower for charging air to the inside of the air bag, an air charging electromotive valve or solenoid valve disposed in the midway of an air charge pipe that connects the blower with the air bag, an air discharging electromotive valve or solenoid valve disposed in the midway of an air discharge pipe for discharging the air from the air bag, and a control device connected at the input thereof to the pressure detector and the water level detectors and connected at the output thereof with the blower, the air charging electromotive valve or solenoid valve, and the air discharging electromotive valve or solenoid valve respectively, in which the control device is so adapted that it opens the air discharging electromotive valve or solenoid valve by a signal from the pressure detector when the inner pressure of the air bag is higher, due to the elevation of the atmospheric temperature, than the predetermined inner pressure value so as to deflate the weir to a predetermined pressure and weir height relative to detected water levels upstream and downstream of the weir. When the control device is also adapted to open the charging electromotive valve or solenoid valve and actuate the blower by a signal from the pressure detector when the inner pressure of the air bag is lower, due to atmospheric temperature, than the predetermined inner pressure value so as to inflate the weir to a predetermined pressure and weir height relative to detected water levels upstream and downstream of the weir, The predetermined inner pressure valve is higher than such an inner pressure that causes V-shaped notches. The control device also closes the air charging electromotive valve or solenoid valve and interrupts the operation of the blower when the inner pressure of the air bag reaches a predetermined value.

The value for the predetermined inner pressure of the air bag, has an upper limit that is lower than the inner pressure causing the designed tension and lower than the designed maximum value for the inner pressure of the air bag, the pressure at which the air in the air bag starts to be discharged from the insertion pipe in the water sealing pipe and a lower limit that is higher than such an inner pressure which causes V-shaped notches.

The designed tension is given as shown below while taking the experimentally determined safety factor for the strength of the air bag material into consideration:

$$\text{Designed tension} = \frac{\text{Strength for the air bag material}}{\text{Safety factor}}$$

BRIEF DESCRIPTION OF THE DRAWINGS

These and other objects, as well as advantageous features of the present invention will become apparent by reading the following descriptions of the preferred embodiment according to the present invention, in relation with the descriptions of the prior art made only for reference, in conjunction with the appended drawings, wherein.

For making the novel feature and advantageous effect of the present invention clearer, explanation will at first be made briefly to the air inflation/deflation weir made of a flexible film in the prior art together with technical problems involved therein which are to be dissolved by the present invention.

DETAILED DESCRIPTION OF THE PREFERRED EMBODIMENTS

Now, the preferred embodiment of the present invention for overcoming the foregoing problems in the prior art will be described below referring to FIG. 1.

Figure 1:
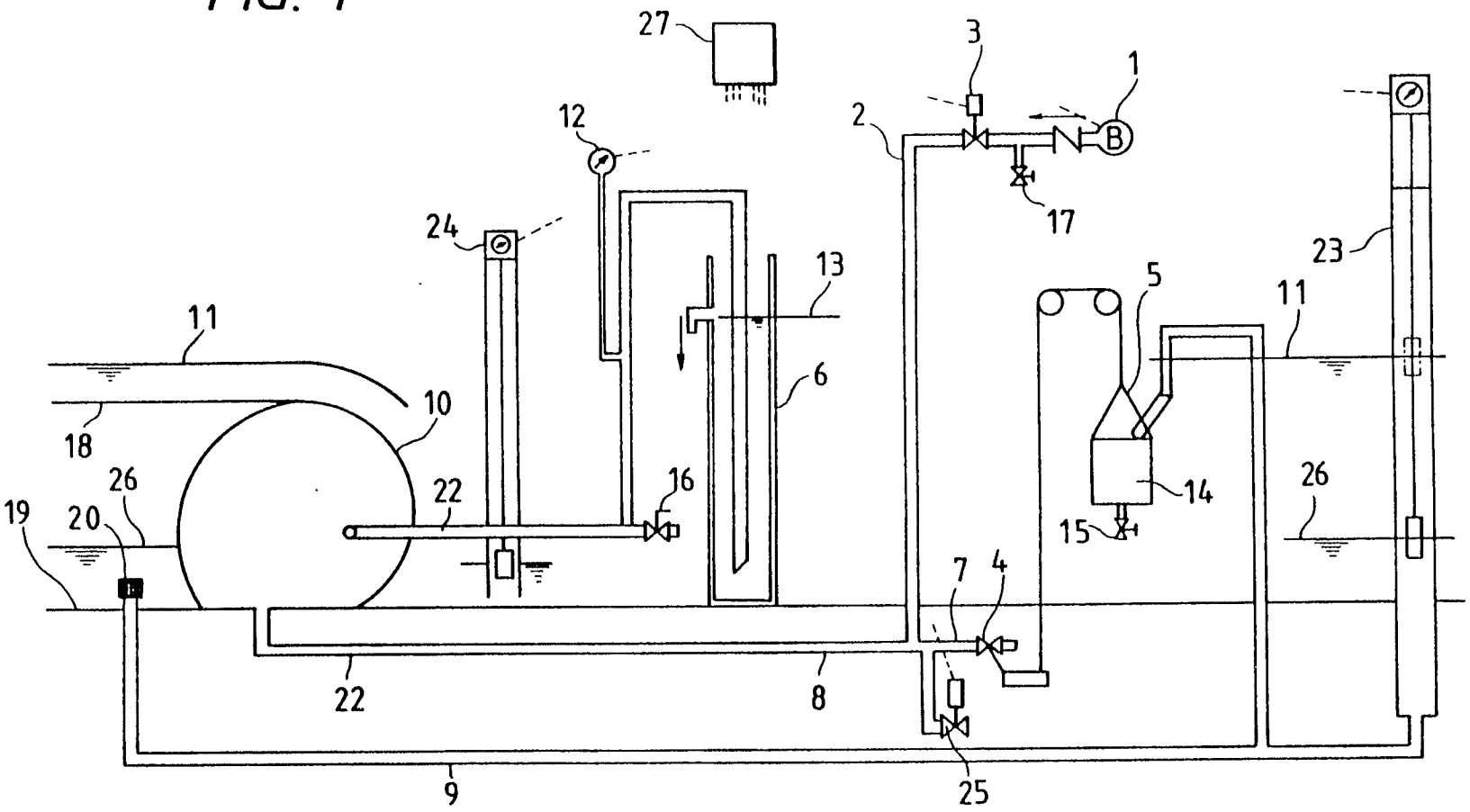
FIG. 1 is a cross sectional view of an air inflation/deflation weir made of a flexible film for the illustration of the present invention.
Figure 2:
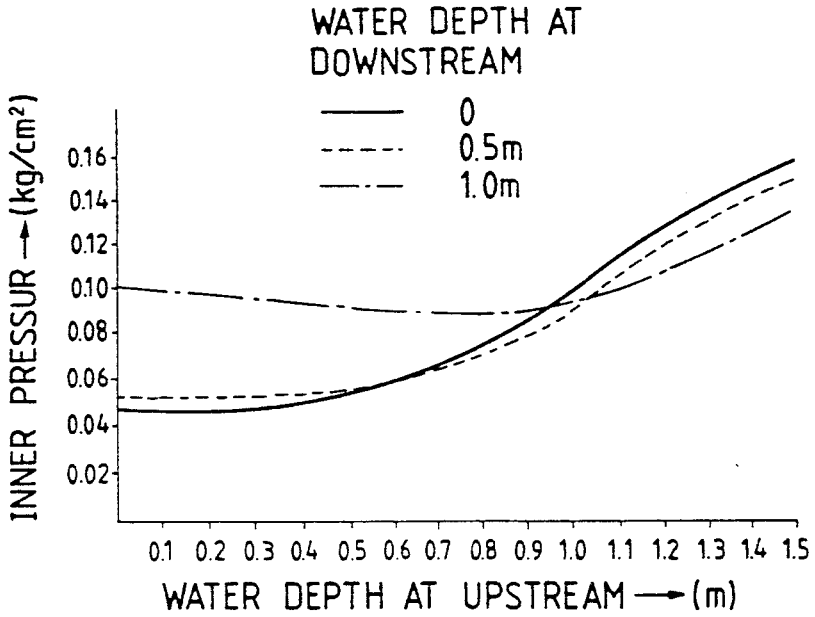
FIG. 2 is a graph illustrating a relationship between the water depth at the upstream and the inner pressure of the air bag in the air inflation/deflation weir made of a flexible film.
Figure 3:
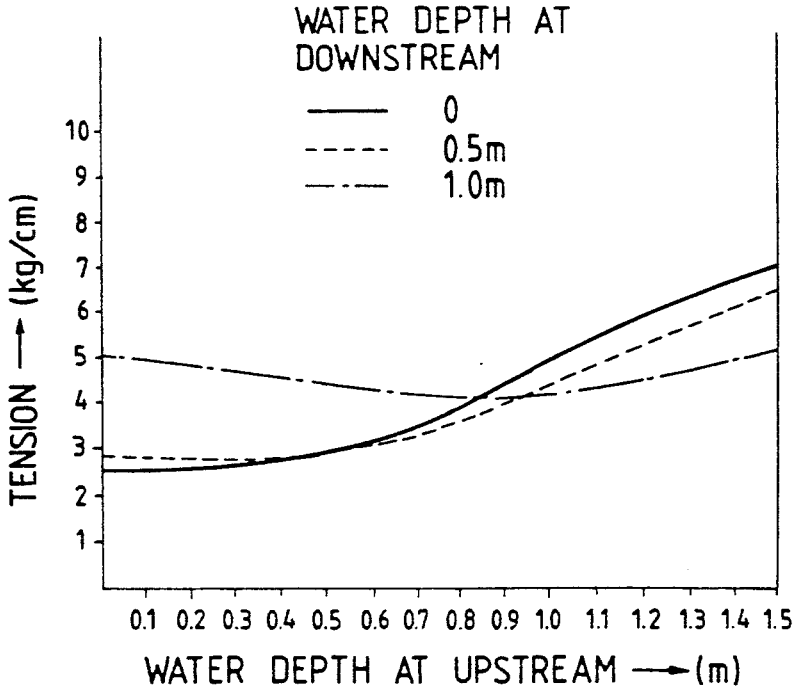
FIG. 3 is a graph illustrating a relationship between the water depth at the upstream and the tension to the air bag film in the air inflation/deflation weir made of a flexible film.
Figures 4, 5:
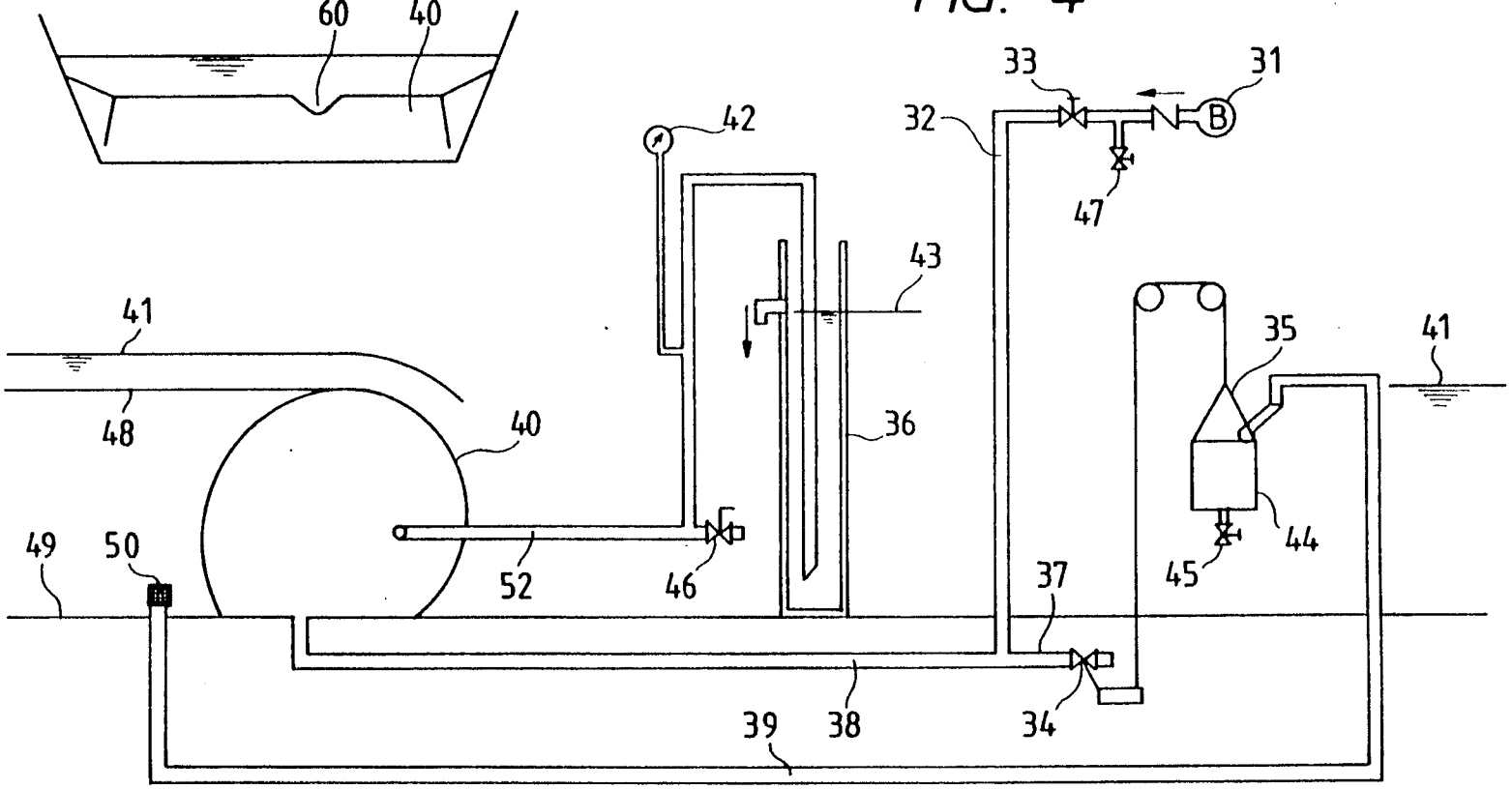
FIG. 4 is a cross sectional view of an air inflation/deflation weir made of a flexible film in the prior art.
FIG. 5 is an explanatory view of V-shaped notches caused in an air inflation/deflation weir made of a flexible film respectively.

The system shown in FIG. 1 comprises a blower 1 for charging air into an air bag 10, a pressure detector 12 for detecting the inner pressure of the air bag 10, water level detectors 23, 24, for detecting water levels at the upstream and the downstream of a weir respectively, an air charge electromotive valve or solenoid valve 3 which is disposed in the middle portion of an air charge pipe 2 for connecting the blower 1 to the air bag 10 and which is opened or closed by a signal from the pressure detector 12, and an air discharge electromotive valve or solenoid valve 25 which is disposed in the middle portion of an air discharge pipe 7 for discharging air from the inside of the air bag 10 and which is opened or closed by a signal from the pressure detector 12. When the inner pressure of the air bag 10 exceeds such a predetermined value as to inflate and rise the weir to a predetermined weir height relative to the detected water levels at the upstream and the downstream of the weir due to the increase of the atmospheric air temperature but is lower than the designed maximum value, the air discharge electromotive valve or solenoid valve 25 is opened by a signal from the pressure detector 12 to reduce the inner pressure of the air bag 10, and the air discharge electromotive valve or solenoid valve 25 is closed when the inner pressure of the air bag 10 reaches a predetermined value, to maintain the inner pressure of the air bag 10 at an appropriate value.

On the other than, when the inner pressure of the air bag 10 goes lower than such a predetermined value as to inflate and drive the weir to a predetermined weigh height relative to the detected water levels at the upstream and the downstream of the weir due to the lowering of the atmospheric temperature but is higher than such an inner pressure as causing V-shaped notches, the air charge electromotive valve or solenoid valve 3 is opened by a signal from a pressure detector 12 and the blower 1 is actuated to increase the inner pressure of the air bag 10. When the inner pressure reaches a predetermined value, the air charge electromotive valve or solenoid valve 3 is closed and the operation of the blower 1 is interrupted to maintain the inner pressure of the air bag 10 to an appropriate value.

The above-mentioned operation is conducted by using a control device 27 which is connected at the input thereof to the pressure detector 12 and the water level detectors 23, 24 and connected at the output thereof to the blower 1, the air discharge electromotive valve or the solenoid valve 3 and air discharge electromotive value or solenoid valve 25.

There are also shown, in FIG. 1, a lever type butterfly valve 4 with weight, a bucket type automatic deflating device 5, an excess pressure preventing device 6 constituted as a water sealing pipe, an air charge/discharge pipe 8, an upstream water level detection pipeline 9, an automatic deflating level 11, a rising lever 13, a water storage bucket 14, a water storage bucket draining valve 15, a lever type butterfly valve 16, a manual valve 17, a weir top and 18, a weir installing reference plane 19, a strainer 20, a bag inner pressure detection pipeline 22 and an automatic rising level 26.

When the system is operated automatically as described above, since air at an excess pressure is automatically discharged even if the temperature of air in the air bag 10 changes under the effect of the atmospheric air temperature, and air is automatically supplemented if the inner pressure of the air bag 10 is lowered. Accordingly, the inner pressure of the air bag 10 is maintained at a predetermined pressure value to inflate and raise the weir to a predetermined weir height relative to the water depth upstream and downstream, which enables to avoid such disadvantages as lowering the strength of the material, causing V-shaped notches which would lead to the loss of stored water or failure of automatic collapse of the weir which would result in flooding of the river.

As has been described above, the method of controlling the inner pressure of the air bag according to the present invention comprises maintaining the inner pressure of the air bag regardless of the change in atmospheric air temperature and maintaining the inner pressure of the air bag to such a predetermined level as to inflate and rise the weir to a predetermined weir height relative to the water levels at the upstream and the downstream of the weir based on such water levels detected.

Further, the air inflation/deflation weir according to the present invention comprises the pressure detector 12, water level detectors 23, 24, the blower 1, the air charge electromotive valve or solenoid valve 3, the air discharge electrode motive valve or solenoid valve 25 and the control device 27.

Since, the present invention provides a method of automatically controlling the inner pressure of the air bag of the weir and a weir having such a system, it can eliminate the change of the inner pressure of the air bag caused by the effect of the atmospheric air temperature as has been described above, as well as it can also be applied, for example, to the control for the water level at the upstream and to the control for the flow rate overflowing the weir, by setting the inner pressure of the air bag so as to inflate and rise the weir to a predetermined weir height relative to the detected water levels at the upstream and the downstream and, accordingly, it can remarkably improve the function of the weir of this type.

What is claimed is:

1. A method of controlling the inner pressure of an air bag of an air inflation/deflation weir made of a flexible film constituting a weir body attached to the bed and the vertical bank side of a river, in which air as a pressure medium is charged to or discharged from the inside of the air bag to inflate or deflate the weir, wherein said method comprises the steps of:

measuring the water levels upstream and downstream of the weir;

determining an ideal height of the weir based on the detected water levels;

determining an ideal inner pressure of the air bag based on the ideal height of the weir;

measuring the actual inner pressure of the air bag;

inflating the air bag with a blower to increase the actual inner pressure if the actual inner pressure is below the ideal inner pressure;

deflating the air bag through a discharge valve to decrease the actual inner pressure if the actual inner pressure is higher than the ideal inner pressure; and maintaining the ideal pressure in the air bag by executing the previous steps.

2. A method of controlling the inner pressure of an air bag of an air inflation/deflation weir made of a flexible film as defined in claim 1, wherein the step of determining the ideal inner pressure comprises the steps of:

determining an upper limit inner pressure which is lower than such inner pressure causing a maximum tension in the weir; and determining a lower limit inner pressure which is higher than such inner pressure causing a v-shaped notch in the weir surface.

3. An air inflation/deflation weir made of a flexible film constituting a weir body attached to the bed and the vertical bank side of a river, in which air as a pressure medium is charged to or discharged from the inside of the air bag thereby inflate or deflate the weir, said weir having a means capable of controlling the inner pressure of said air bag, that is, capable of eliminating the change of the inner pressure of said air bag depending on the change of the atmospheric air temperature and capable of maintaining the inner pressure of said air bag to such a pressure value predetermined so as to inflate and rise the weir body to a predetermined weir height relative to the water levels at the upstream and the downstream of the weir based on such water levels detected, wherein said means for eliminating the change of the inner pressure of said air bag depending on the change of the atmospheric air temperature and capable of maintaining the inner pressure of said air bag to such a pressure value predetermined so as to inflate and rise the weir body to a predetermined weir height relative to the water levels at the upstream and the downstream of the weir based on said water levels detected comprises a pressure detector for detecting the inner pressure of said air bag, water level detectors for detecting water levels at the upstream and the downstream of said weir respectively, a blower for charging air to the inside of the air bag, an air charge electromotive valve or solenoid valve disposed in the midway of an air charge pipe that connects the blower with said air bag, an air discharge electromotive valve or solenoid valve disposed in the midway of an air charge pipe that connects the blower with said air bag, an air discharge electromotive valve or solenoid valve disposed in the midway of the air discharge pipe for discharging the air from the inside of said air bag and a control device connected at the input thereof with said pressure detector and the water level detectors and connected at the output thereof with the blower, the air charge electromotive valve or solenoid valve and the air discharge, electromotive valve or solenoid valve respectively, in which said control device is so adapted that it opens the air discharge electromotive valve or solenoid valve by a signal from the pressure detector when the inner pressure of said air bag is higher than such an inner pressure value that is predetermined, so as to inflate and rise the weir body to a predetermined weir height relative to the detect water levels at the upstream and the downstream of the weir but is lower than the designed maximum value due to the elevation of the atmospheric temperature, to thereby lower the inner pressure of said air bag, while it closes the air discharge electromotive valve or solenoid valve when the inner pressure of said air bag reaches the predetermined value, as well as so adapted that it opens the air charge electromotive valve or solenoid valve and actuates the blower by a signal from the pressure detector when the inner pressure of said air bag goes lower than such a predetermined value as to inflate and rise the weir body to a predetermined weir height relative to the detected water levels at the upstream and the down stream of the weir but is higher than such an inner pressure of said air bag as causing V-shaped notches due to the lowering of the atmospheric air temperature, to elevate the inner pressure of said air bag and closes the air charge electromotive valve or solenoid valve and interrupts the operation of the blower when the inner pressure reaches a predetermined pressure value.

4. An air inflation/deflation weir made of a flexible film as defined in claim 3, wherein the inner pressure value of the air bag predetermined so as to inflate and rise the weir to a predetermined weir height relative to the water levels at the upstream and the downstream has an upper limit which is lower than such an inner pressure as causing a designed tension and a lower limit which is higher than such an inner pressure as causing V-shaped notch and lower than a designed maximum value for the inner pressure of the air bag.

5. An air inflation/deflation weir made of a flexible film constituting a weir body attached to the bed and the vertical bank side of a river, in which air as a pressure medium is charged into or discharged out of the air bag thereby inflating or deflating the weir, said weir having a means capable of maintaining a specific inner pressure of said air bag which compensates for changes in atmospheric air temperature and inflates or deflates the weir body to a predetermined pressure and height relative to the water levels upstream and downstream of the weir, comprising:

a pressure detector for detecting the inner pressure of said air bag;

water level detectors for detecting water levels upstream and downstream of said weir;

a blower for charging air to the inside of the air bag;

an air charge electromotive valve or solenoid valve disposed in the midway of an air charge pipe that connects the blower with said air bag;

an air discharge electromotive valve or solenoid valve disposed in the midway of the air discharge pipe for discharging the air from the inside of said air bag; and a control device that receives input from said pressure detector and the water level detectors and produces output to the blower, the air charge electromotive valve or solenoid valve, and the air discharge electromotive valve or solenoid valve, the control device is so adapted to open the air discharge electromotive valve or solenoid valve by a signal from the pressure detector when the inner pressure of said air bag is higher, due to an elevation of atmospheric temperature, than a predetermined inner pressure, so as to deflate and lower the weir body to a predetermined weir height relative to the water levels upstream and downstream of the weir, and to close the air discharge electromotive valve or solenoid valve when the inner pressure of said air bag reaches the predetermined value, as well as so adapted to open the air charge electromotive valve or solenoid valve and actuate the blower by a signal from the pressure detector when the inner pressure of said air bag is lower, due to a low atmospheric air temperature, than a predetermined value so as to inflate and raise the weir body to a predetermined weir height relative to the detected water levels upstream and downstream of the weir and elevate the inner pressure of said air bag, and close the air charge electromotive valve or solenoid valve and interrupt the operation of the blower when the inner pressure reaches a predetermined pressure value.

6. An air inflation/deflation weir made of a flexible film as defined in claim 3, wherein the predetermined inner pressure has an upper limit which is lower than an inner pressure that causes a designed tension in the weir body, and a lower limit which is higher than such an inner pressure that causes a v-shaped notch in the weir body.

* * * * *